United States Patent [19]

Contreras, Sr.

[11] Patent Number: 4,917,131

[45] **Date of Patent: * Apr. 17, 1990**

[54] LATCH ASSEMBLY AND FRONT RELEASE MECHANISM FOR COMPACTS AND OTHER CONTAINERS

[76] Inventor: Joseph P. Contreras, Sr., 6 Brockden Dr., Mendham, N.J. 07945

[ * ] Notice: The portion of the term of this patent subsequent to Jun. 19, 2001 has been disclaimed.

[21] Appl. No.: 730,450

[22] Filed: May 6, 1985

[51] Int. Cl.[4] ..... A45D 33/00

[52] U.S. Cl. ..... 132/301; 132/286; 132/301; 206/37; 206/235; 206/581; 220/256; 220/344

[58] Field of Search ..... 132/83 R, 79, 82 F, 132/293, 301, 286; 206/37, 235, 581; 220/256, 344

[56] References Cited

U.S. PATENT DOCUMENTS

| | | | |
|---|---|---|---|
| 4,276,893 | 7/1981 | Enomoto et al. | 132/83 R |
| 4,345,607 | 8/1982 | Contraras et al. | 132/83 R |
| 4,366,829 | 1/1983 | Yuhara | 132/83 R |
| 4,387,730 | 6/1983 | Shioi | 132/83 R |
| 4,392,503 | 7/1983 | Watanabe | 132/83 R |
| 4,399,826 | 8/1983 | Ogasawara | 132/83 R |
| 4,454,889 | 6/1984 | Contraras, Sr. | 132/83 R |
| 4,474,196 | 10/1984 | Yuhara | 132/83 R |
| 4,483,355 | 11/1984 | Yuhara | 132/83 R |

FOREIGN PATENT DOCUMENTS

| | | | |
|---|---|---|---|
| 3209987 | 3/1983 | Fed. Rep. of Germany | 132/83 R |

*Primary Examiner*—Joseph Falk

*Assistant Examiner*—J. Hakomaki

*Attorney, Agent, or Firm*—Lerner, David, Littenberg, Krumholz & Mentlik

[57] ABSTRACT

A compact or container has a base member defining a receptacle, a cover hingedly connected to the base member for pivotal movement from closed to open position and vice versa, and an insert assembly connected on the receptacle in the base member has, a flange and at least one storage compartment therein for cosmetics or other materials, a catch having an inwardly inclined outer face is formed on the insert assembly, a latch having an inwardly inclined inner face is formed on the cover and is disposed in mating engagement with the catch when the cover is pivoted to the closed position, and a front release assembly is slidably mounted in a cut-out section in the base member and includes a resilient coacting member to permit reciprocable movement thereof, the said front release has an inclined surface disposed to engage the latch to release the latch from engagement with the catch so that the cover member can be moved to open position.

The compact or container as above described including, an annular element formed to make the storage compartment substantially air tight in the closed position.

Additionally, the compact or container as above described wherein the base member has a boss adjacent the hinge connected end of the cover and the base member which requires additional external force to move the cover member from open to closed position and vice versa, and produces an audible sound on movement to the closed position.

3 Claims, 4 Drawing Sheets

LATCH ASSEMBLY AND FRONT RELEASE MECHANISM FOR COMPACTS AND OTHER CONTAINERS

BACKGROUND OF THE INVENTION

This invention relates generally to a release mechanism for the closure assembly on containers and more particularly to a latch assembly and front release mechanism for the closure on compacts or containers generally and which is equally applicable to compacts or containers having an air tight closure.

Containers such as compacts for holding and storing powder, rouge or other cosmetics are well known in the art. Such compacts have a base member with a compartment therein for holding and storing the desired cosmetic and a closure or cover member which is pivotally hinged to the base member for movement of the cover member between a closed and an open position so that the user of the compact can gain access to the cosmetic when desired by opening the closure or cover member and can seal the cosmetic in the base member by closing the cover or closure member.

Such compacts generally include a conventional externally disposed interference type clasp or latching unit located at a point on the compact opposite or remote from the pivotal connection for the cover member. These externally disposed latching units operate to lock the cover member to the base member when the cover member is moved to the closed position. In order to open the compact, the user merely applies a separating force to the cover member and base member sufficient to overcome the locking force of the clasp unit. Conversely by applying a like force to the cover and base member, the cover on movement to the closed position will enable the clasp or latching unit to be returned to the closed or locked position.

The clasp unit is generally formed by two elements one generally a latch on the front and visible exterior surface of the cove member and the other a strike or keeper on the base member which interengage with each other in the closed position.

Such externally disposed clasp or latching units however, detract from the aesthetic appearance of the compact. One means for overcoming this problem is to totally enclose the clasp or latching unit on the interior section of the compact. However, this arrangement is more complicated than that of the externally positioned latching unit and may present difficulties in moving the closure for the compact case to the open position.

Various prior art latching and release mechanisms have been disclosed for overcoming this problem of concealing the clasp unit as is shown in U.S. Pat. Nos. 4,276,893; 4,387,730; and 4,399,826.

In U.S. Pat. No. 4,276,893, a sliding member is held in assembled position by the bezel of the compact so that by camming action it can force the cover out of engagement with the strike or keeper on the bezel of the compact.

Similarly, in U.S. Pat. No. 4,387,73O, a sliding element is held in assembled position by a bracket and spring element in the base of the compact so that by camming action the sliding element can force the latch on the cover member to disengage from the latched or closed position with the underside of a keeper element when the sliding element is forced inwardly by manual pressure.

In U.S. Pat. No. 4,399,826, an L-shaped member is shown pivotally connected in a cut-out on the front section of the base member. When pressure is applied to the front and longer section of the L-shaped member, the shorter section exerts camming action against the lower face of the latch to force the latch over the keeper, thus moving the cover to its open position.

In a similar manner, as applied to a container having a safety lid pivotally connected thereto, U.S. Pat. No. 4,146,146 discloses the safety lid having a skirt or annular flange inwardly of the periphery thereof which is sized to fit into the mouth of the container so as to form a fluid tight connection. A locking member or pin is slidably movable in a transverse housing so that when the safety lid is moved to its closed position, the shaped head with beveled sides can be moved radially inward into engagement with the recessed section with beveled sides in the collar about the mouth of the container.

Other patents which are less pertinent, but nonetheless relevant, are U.S. Pat. Nos. 1,950,465; 3,077,281; 3,412,890; and 3,556,337.

The above prior art devices are relatively complex latching and release arrangements from a manufacturing point of view. Therefore, compacts or containers utilizing these arrangements are more costly than compacts or containers with simpler latching assemblies because of the time required for manufacturing, assembly and testing. This is particularly so for high quality compacts.

The present invention provides an improved latching assembly for the closure on a compact or container having a novel yet simple front release mechanism so that high quality compacts can be manufactured, assembled and marketed at a relatively lower cost.

This improved latch assembly and front release mechanism in accordance with the present invention is particularly adaptable for use on the more costly variety of high quality compacts and containers which have an air tight seal mechanism thereon. Such compacts and containers are becoming more in vogue in the cosmetic trade because of new cosmetics being offered to the public which require that the solvent for the cosmetic compositions be maintained for a reasonable life period in order to make these compacts commercially feasible.

Such air tight compacts and containers are made as aesthetically pleasing as possible. Therefore it is highly desirable to provide the improved latching assembly and front release mechanism in accordance with the present invention for such units as well as other types of compacts and containers particularly those used in the cosmetic trade.

OBJECTS AND SUMMARY OF THE INVENTION

Accordingly, it is an object of the present invention to provide a compact having an improved latch assembly and front release mechanism.

More importantly, it is an object of the present invention to provide a compact having a front release mechanism for opening the compact case that is rugged, relatively easy to use, and inexpensive to manufacture.

It is another object of the present invention to provide an improved latch assembly and front release mechanism for compacts or containers in which the closure member is operatively associated with an air tight seal.

In accordance with the present invention, a compact or container includes, a base member defining a receptacle, a cover member pivotally connected to the base member for movement from close to open position and vice versa, and an insert assembly connected in said base member has a flange, and at least one storage compartment, catch means having an inwardly extending inclined outer surface formed at the front end of the insert assembly, latch means at the front end of the cover member having an inwardly extending inner surface disposed to coact with said latch means to lock the cover member in the closed position on closing movement thereof, and a front release assembly slidably mounted on the base member having an inwardly extending inclined surface disposed on inward movement for operative engagement with the latch means to force the same to disengage from the catch means, and resilient means for returning the front release means to the non-engaging position.

Additionally, the compact or container as above described having means for rendering the storage compartment in the insert assembly substantially air tight.

Additionally, the compact or container as above described having a boss on the hinged end of the base member to coact with the cover for establishing affirmative closing action with an audible sound on both closing and opening movement.

The above, and other, objects, features and advantages of the present invention will become readily apparent from the following detailed description thereof which is to be read in connection with the accompanying drawings.

DETAILED DESCRIPTION OF THE PREFERRED EMBODIMENTS

Figure 1:
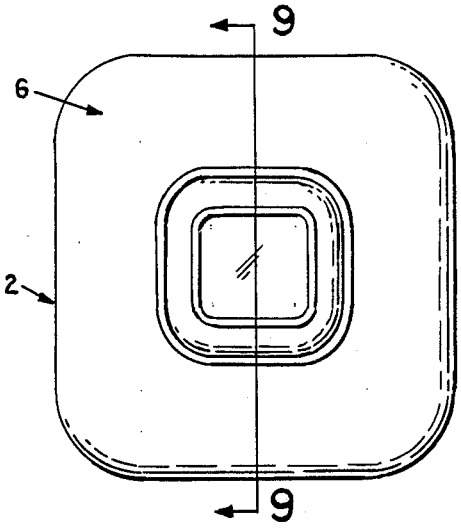
FIG. 1 is a top plan view of a compact according to one embodiment of the present invention.
Figure 2:
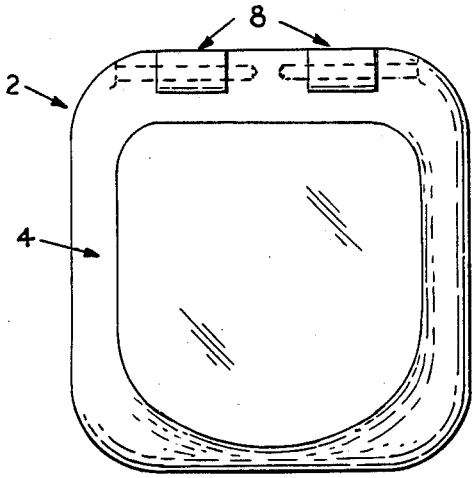
FIG. 2 is a bottom plan view of the compact shown in FIG. 1.
Figure 3:
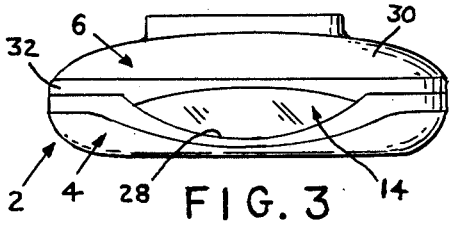
FIG. 3 is a front elevational view of the compact shown in FIG. 1.

Referring to the drawings in detail, and initially to FIGS. 1–19 thereof, the compact or container 2 according to the first embodiment of the present invention generally include a base member 4, a cover member 6, a hinge assembly 8 which pivotally connects cover member 6 to base member 4 for movement between an open and closed position, an insert assembly 10 positioned within base member 4, a front latch assembly generally designated 12 for locking cover member 6 to base member 4 in the closed position, and a front release mechanism 14 which disengages the front latch assembly to open the compact case in response to an externally applied force.

Figure 6:
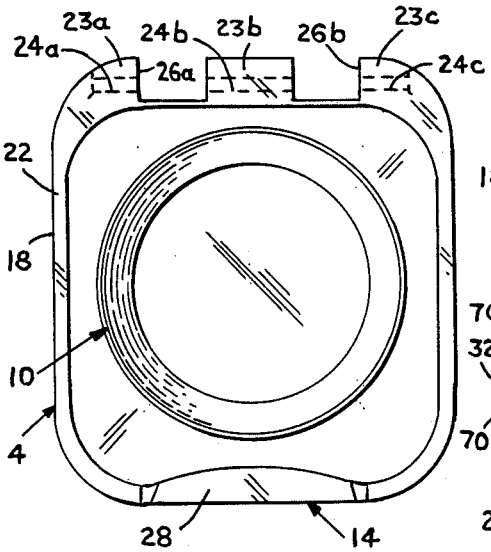
FIG. 6 is a top plan view of the base member for the compact shown in FIG. 1 with the cover removed.
Figure 5:
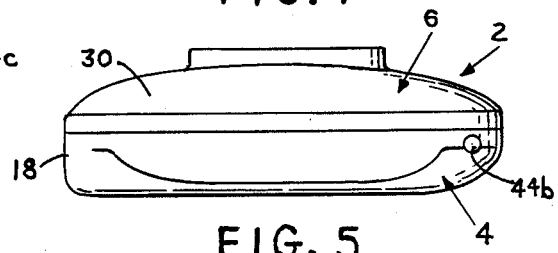
FIG. 5 is a side elevational view of the compact shown in FIG. 1.
Figure 8:
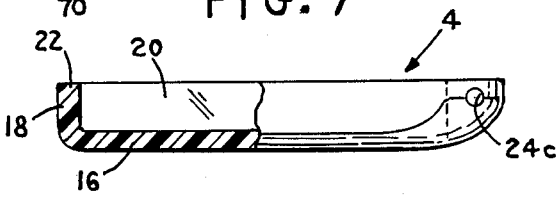
FIG. 8 is a side elevational view, partly in cross-section, of the base member for the compact shown in FIG. 1 with the storage compartment support assembly, storage compartment and other elements removed.
Figure 10:
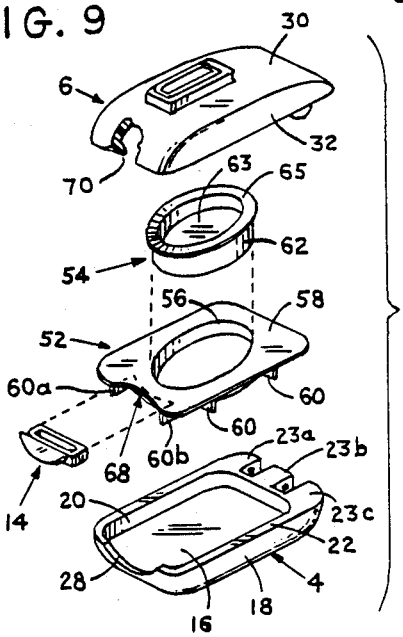
FIG. 10 is an exploded, perspective view of the compact shown in FIGS. 1 to 9A of the drawings.
Figure 11:
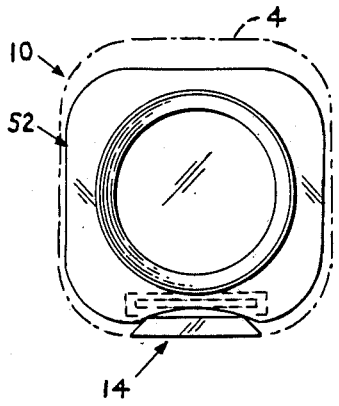
FIG. 11 s a top plan view of the storage compartment support assembly, the storage compartment in assembled position therein, and the relationship thereof to front release mechanism for the compact case shown in FIG. 1.
Figure 12:
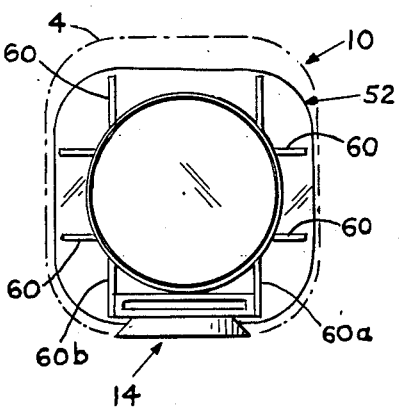
FIG. 12 is a bottom plan view of the storage compartment support assembly, the bottom of the storage compartment in assembled position therein; and the front release mechanism in FIG. 11.
Figure 14:
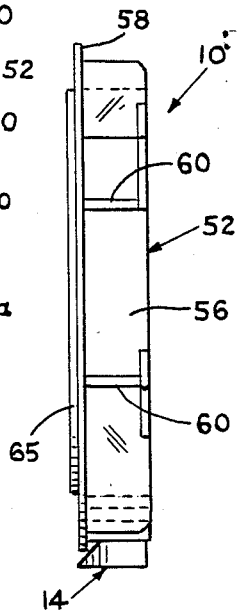
FIG. 14 is a side elevational view of the storage compartment support assembly, the storage compartment therein, and the front release mechanism shown in FIG. 11.
Figure 13:
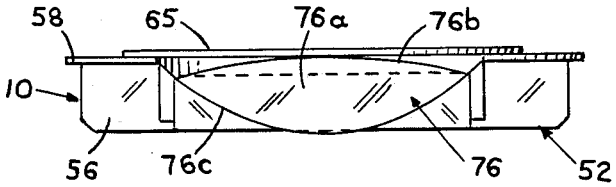
FIG. 13 is a front elevational view of the storage compartment support assembly, the storage compartment therein, and the front release mechanism shown in FIG. 11.
Figure 15:
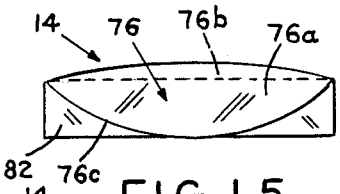
FIG. 15 is a front elevational view of the front release mechanism for the compact shown in FIGS. 1 to 11 of the drawings.

As shown in FIGS. 2–6, 8 and 10, base member 4 includes a bottom wall 16 and a peripheral wall 18 circumferentially disposed and integrally formed about bottom wall 16 so as to define a chamber or receptacle 20. As shown in FIGS. 6, 8 and 10, the upper end of peripheral wall 18 forms a substantially flat, planar surface 22.

Figure 4:
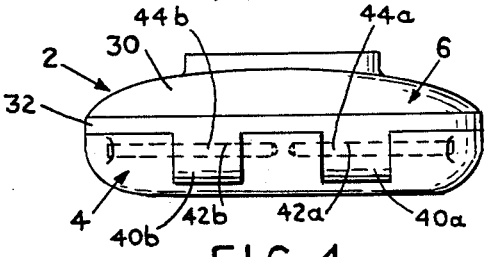
FIG. 4 is a rear elevational view of the compact shown in FIG. 1.

At the rear of base member 4, as shown in FIGS. 4, 6, 8 and 10, are spaced hinge supports **23*a*, 23*b* and 23*c* with aligned hinge pin shaft openings 24*a*, 24*b* and 24*c*, respectively. The hinge supports 23*a*, 23*b* and 23*c* define two spaced recesses 26*a* and 26*b*, respectively, as shown in FIGS. 4, 6 and 10** of the drawings.

Figure 7:
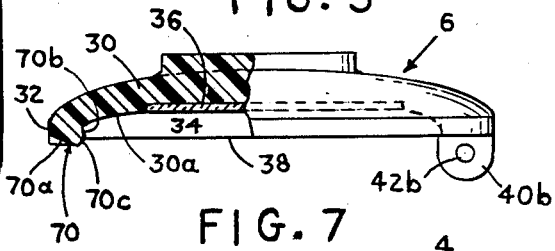
FIG. 7 is a side elevational view, partly in cross-section, of the cover member for the compact shown in FIG. 1.
Figure 9:
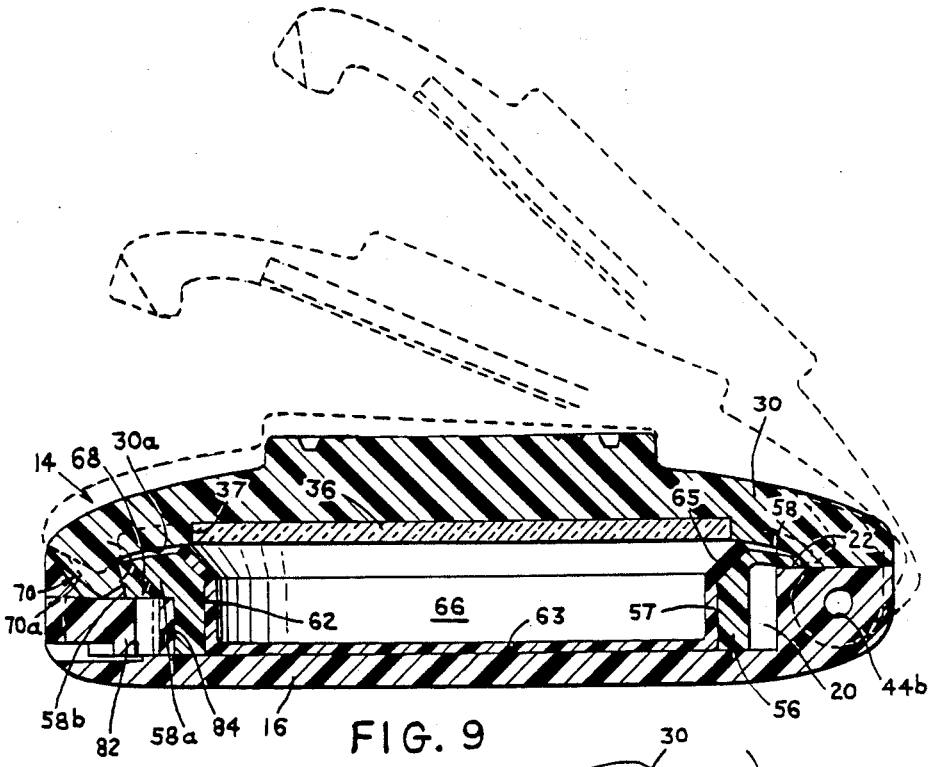
FIG. 9 is a cross-sectional view of the compact shown in FIG. 1, taken along line 9—9 thereof.

Referring now to FIGS. 1, 3, 4, 5, 7 and 10, cover 6 has substantially an identical configuration to base member 4. Thus, cover 6 has a top wall 30 and a peripheral wall 32 circumferentially disposed and integrally formed about the top wall 30 to define a cavity 34 which is adapted for various purposes, such as the mounting of a mirror 36 shown in FIGS. 7 and 9. More particularly, mirror 36 is set and affixed in an annular recess 37 formed in the inner wall of top cover 6. FIGS. 7 and 9 further show that the lower edge of cover member 6 is formed with an annular, flat rim 38 which in the closed position is disposed in mating engagement with the upper surface 22 of peripheral wall 18 of base member 4.

FIGS. 4, 7, 9 and 10 show spaced coacting and projecting hinge members 40*a* and 40*b* formed on cover member 6 on centers which correspond to the centers of recesses 26*a* and 26*b* in the base member 4. The spaced hinge members 40*a* and 40*b* in assembled position depend downwardly from the rear end section of peripheral wall 32 and are molded and formed continuous therewith. The hinge members 40*a* and 40*b* have aligned hinge pin shaft openings as at 42*a* and 42*b* so that when hinge members 40*a* and 40*b* are aligned and fitted into spaced recesses 26*a* and 26*b*, hinge pins 44*a* and 44*b* respectively, can be pressed through the aligned hinge pin shaft openings as at 24*a*, 42*a* and 24*b* for one set of hinge elements and 24*c*, 42*b* and 24*b* for the other set of hinge elements. Alternatively, a single hinge pin, not shown, rather than two hinge pins 44*a* and 44*b* can be used. In this manner, cover member 6 is hingedly connected at the rear end thereof to base member 4.

Base member 4 and cover or closure member 6 are molded as integral units from plastic materials such as polypropylene, acrylonitrile-butadiene-styrene (ABS), and polycarbonate which have sufficient strength and thermoplastic memory to enable the improved latching assembly and front release mechanism to operate in accordance with the present invention.

In accordance with this embodiment of the present invention, an insert assembly 10 is fixedly positioned in the chamber or receptacle 20 defined in base member 4. Insert assembly 10 includes, storage compartment support 52 which in assembled position is preferably fixedly connected within chamber or receptacle 20 to the base member 4. A storage compartment 54 for powder, rouge or the like type of granular cosmetic is removably mounted within the storage compartment support 52, all of which is shown in FIGS. 9, 10, 11, 12 and 13 of the drawings.

FIGS. 9 to 13 further show that storage compartment support 52 has an annular side wall 56 defining an opening 57. A flange 58 formed integrally with side wall 56 extends outwardly from the upper end thereof. Preferably, side wall 56 and flange 58 are dimensioned such that flange 58 rests on the flat, planar surface 22 of peripheral wall 18 and, at the same time, side wall 56 rests upon bottom wall 16 of base member 4, as shown in FIG. 9. In order to strengthen and generally center side wall 56 within the chamber or receptacle 20 of base member 4, a plurality of guides 60 are integrally connected with side wall 56 and the underside of flange 50 of the storage compartment support 52 and extend outwardly from side wall 56 substantially into engagement with peripheral wall 18 of base member 4.

Storage compartment 54 is formed with an annular side wall 62 of a similar configuration to downwardly extending side wall 56, which fits within opening 57 defined thereby, and a bottom wall 63 integral with side wall 62. Annular side wall 62 is formed at its upper end with a lip 65 which extends above the upper surface of flange 58 into sealing contact with that portion 30*a* of the inner surface of top wall 30 of cover member 6 which surrounds mirror 34 so as to provide an air tight seal for the powder, rouge or the like type of granular material contained within the chamber 66 of compartment 54 defined by side wall 62 and bottom wall 63 of compartment 54, as shown in FIGS. 9 and 10 of the drawings.

FRONT LATCH ASSEMBLY

Figure 9A:
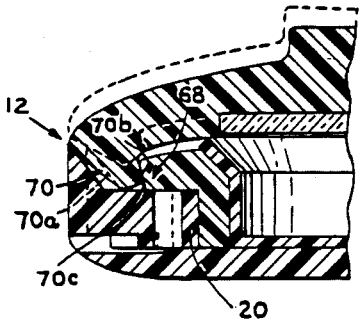
FIG. 9A is a partial enlarged drawing of a fragment of the compact shown in FIG. 9 to clearly illustrate the improved latching assembly and front release mechanism.

Referring further to FIGS. 9 to 13 of the drawings and more particularly at FIGS. 9, 9A and 10, the front end of storage compartment support 52 is shown as having a catch 68 formed by an undercut or downwardly depending section in an arcuate cut-away of the front end of flange 58 thereof. FIGS. 9 and 9A show that flange 58 is formed at its front end with a thicker section 58*a*, having a peripheral edge 58*b* inclined inwardly from the upper surface thereof, by which catch 68 is formed and is operative as one part of the front latch assembly 12.

At the front end of cover member 6, substantially opposite hinge members 40*a* and 40*b*, peripheral wall 32 is formed with a latch member 70 integral therewith and which extends down past annular flat rim 38. Latch member 70 has a peripheral edge 70*a* with an inclined inner surface 70*b* similar to that of the catch 68 which inner surface 70*b* terminates in a rounded end 70*c*, all of which is shown in enlarged FIG. 9*a*. Latch member 70 forms the other part of the front latch assembly 12.

Thus, when cover member 6 is pivoted towards the closed position, rounded end 70*c* and inwardly extending inclined surface 70*b* of latch member 70 engage catch 68. During this portion of the closing movement latch member 70 is biased outwardly, as is shown by the dashed lines in FIGS. 9 and 9A. Upon passing over catch 68 latch member 70 by reason of the resilient nature of the material from which the cover member 6 is made springs back to its original unbiased position as shown in FIG. 9. In this position the compact is closed because latch member 70 is restrained from upward movement by catch 68 and this locks the cover member 6 in this closed position. In order to move the cover member 6 to open position, a front release mechanism 14 coacts with the front latch assembly 12, as will now be described.

FRONT RELEASE MECHANISM

At the end of base member 4, opposite hinge support 23*b* and below thicker section 58*a* of flange 58, peripheral wall 18 is formed or molded to provide an arcuate cut-out section 28.

Two sections of the guides 60 as at 60*a* and 60*b* of storage compartment support 52 are positioned adjacent to the arcuate cut-out section 28 but on opposite sides thereof below flange 58 to guide movement of the front release mechanism 14. Front release mechanism 14 is further shown particularly in FIGS. 9 to 19, in assembled position in the cut-out section 28 of base member 4 between the front of the base member 4 and cover member 6 so that on movement between guides 60*a* and 60*b* it will bias the latch member 70 out of engagement with catch 68. This can be accomplished by the application of a manually directed inward force on the front release.

Figure 16:
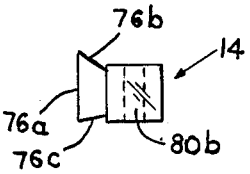
FIG. 16 is a side elevational view of the front release mechanism shown in FIG. 15.
Figure 17:
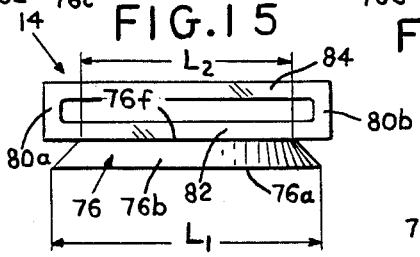
FIG. 17 is a top plan view of the front release mechanism shown in FIG. 15.

Front release mechanism 14 includes a push button or manual contact member 76 having a front face 76*a* to which the external force is applied. Contact member 76 has upper and lower convex surfaces 76*b* and 76*c* extending inwardly from the edges of front face 76a which correspond to the arcuate configurations of latch member 70 and arcuate cut-out section 28, as shown more particularly in FIG. 3 of the drawings. FIGS. 16 and 17 show that the upper surface 76b of contact member 76 is inclined downwardly in the direction from the exterior of compact 2 to the interior thereof for biasing latch member 70 out of engagement with catch 68. Further, the side edges 76d and 76e of contact member 76 which separate surfaces 76b and 76c are inclined rearwardly toward each other such that the lengthwise direction of $L_1$ of front face 76a is greater than the lengthwise direction $L_2$ of the rear face 76f of contact member 76 for reasons that will be clear from the description which now follows.

Figure 19:
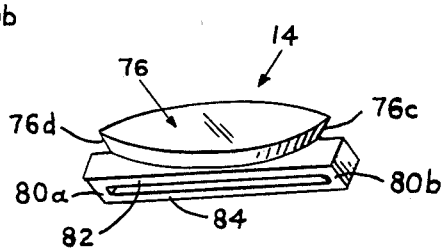
FIG. 19 is a perspective view of the front release mechanism shown in FIG. 15.
Figure 18:
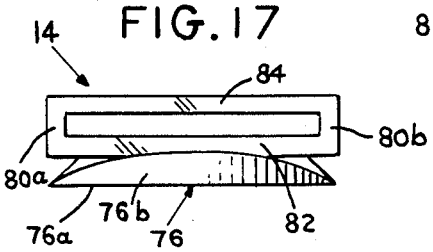
FIG. 18 is a bottom plan view of the front release mechanism shown in FIG. 15.
Figure 20:
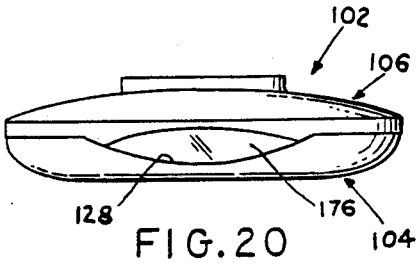
FIG. 20 is a front elevational view of a compact according to another embodiment of the present invention.
Figure 21:
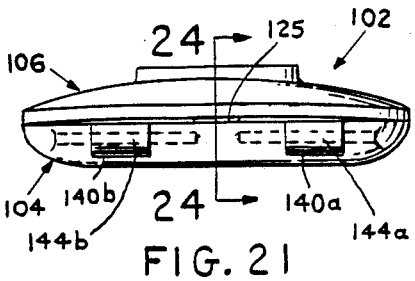
FIG. 21 is a rear elevational view of the compact shown in FIG. 20.
Figure 22:
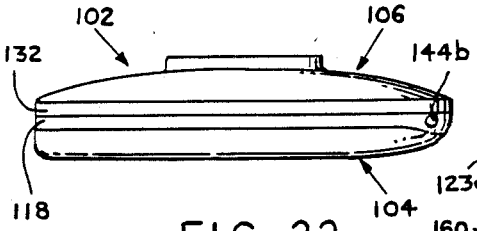
FIG. 22 is a side elevational view of the compact shown in FIG. 20.

First and second side edges 80a and 80b of front release mechanism 14 are connected on opposite sides to the rear face 76f of contact member 76, so as to slide between guides 60a and 60b of storage compartment support 52 and below flange 58 thereof on movement of the front release mechanism 14. As shown in FIGS. 17, 18 and 19, spaced side edges 80a and 80b are preferably connected to rear face 76f of contact member 76 through an intermediate connection member 82 which is connected to rear face 76f substantially parallel thereto and extends to the aforementioned lengthwise dimension $L_1$ greater than the lengthwise direction $L_2$ of rear face 76f. Thus, since contact member 76 is tapered from an external dimension $L_1$ to a shorter internal dimension $L_2$, front release mechanism 14, when positioned within compact 2, as above described cannot escape therefrom because the overextended ends of intermediate connection member 82 abut against the inner surface of peripheral wall 18. At the same time, however, inward depression of front release mechanism 14 along first and second guides 74 is permitted. Front release mechanism 14 is also retained within compact 2 by being positioned beneath flange 58 of storage compartment support 52, as shown in FIG. 9.

Front release mechanism 14, as shown in FIGS. 16 to 19, is provided with a spring member 84 which is formed of a resilient piece of plastic material connecting the free ends of guide members 80 and positioned parallel and spaced apart from intermediate connection member 82. When the front release mechanism 14 is positioned within compact 2, the outer surface of spring member 84 is positioned in abutting relation with the outer surface of side wall 56 of storage compartment support 52 which thereby forms a spring retaining wall. Alternatively, side wall 56 may be omitted, whereby spring member 84 is positioned in abutting relation with the outer surface of side wall 62 of storage compartment 54, such that the latter forms the spring retaining wall. When the external force is applied against contact member 76 so as to press the same inwardly into the compact 2 between guides 60a and 60b, spring member 84 is caused to bend around side wall 56. When the externally applied force is removed, spring member 84 assumes its original configuration shown in FIGS. 11, 12, 17, 18 and 19 to thereby bias contact member 76 outwardly to its original position. Of course, as previously described, the extent that spring member 84 can bias contact member 76 outwardly is limited by intermediate connection member 82 which abuts against the inner surface of peripheral wall 18.

The angular extent of the inclined surface on the catch 68 or latch 70 is a function of the size and shape of the opening in a given compact and the force which must be exerted on the front release assembly to disengage the latch 70 from the closed position. This will vary from one size compact to another of a different size and also depends in part on the resiliency of the material used for the cover and the stiffness of the material used for the front release mechanism.

OPERATION

In operation, to move cover member 6 from its open to its closed position, cover member 6 is pivoted about hinge pins 44a and 44b toward its closed position. During such movement, latch member 70 at the front edge of cover member 6 engages and is biased outwardly by catch 68. Upon continued pivotal movement latch member 70 travels around catch 68. Because peripheral surface 58b of catch 68 is inclined inwardly from the upper surface thereof, upon full closure, latch member 70 assumes its original configuration such that latch member 70 is locked in this position by catch 68, and thereby moves cover member 6 to the closed or locked position relative the base member 4, as shown in FIG. 9 of the drawings. At such time, lip 65 provides an air tight seal with the inner surface 30a of top wall 30 of cover member 6.

To open compact 2, contact face 76 of the front release mechanism 14 is pressed inwardly. This will cause front release mechanism 14 to move inwardly between guides 60a and 60b. During such movement, the upper, inclined surface 76b of contact member 76 biases latch member 70 and the cover member 6, upwardly and out of engagement with catch 68 to release cover member 6 from its latched or closed position. In actuality, the disengagement of latch 70 from catch 68 results in a so-called popping out of latch 70 from engagement with catch 68, and a corresponding clicking, snapping or similar audible sound is heard when this occurs.

SECOND EMBODIMENT

Referring now to FIGS. 20 to 25, a compact 102 according to a second embodiment of the present invention will now be described, in which elements corresponding to those described above with reference to the embodiment of FIGS. 1 to 19 are identified by the same reference numerals augmented by "100", and a detailed description thereof will be omitted for the sake of brevity.

As shown in FIGS. 20 to 25; at the rear of base member 4 and positioned on center hinge support 123b; is a sized and solid boss or raised section 125 formed continuous and integral with the associated rear end of base member 104. Boss 125 is so fixed that it is not resilient for reasons that will appear clear when the operation of the present invention is described. Further, boss 125 may be rounded at its outer peripheral edge, in the manner described in U.S. Pat. No. 4,345,607 to Joseph P. Contreras, Sr. and George A. Sass, entitled Spring Latch and Hinge Assembly for Closure Members, the entire disclosure of which is incorporated herein by reference. With this arrangement, during closure of cover member 106, boss 125 causes cover member 106, which is resilient, to bow and compress, and after rotation through a predetermined angular extent, will affirmatively force cover member 106 into its closed position. Cover member 106 is therefore further held in its closed position, thereby ensuring an air tight seal for the cosmetic material within container 154.

Figure 25:
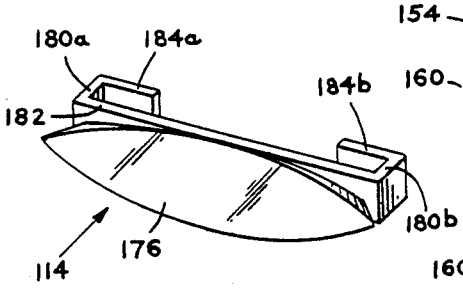
FIG. 25 is a perspective view of the front release mechanism according to another embodiment of the present invention in FIGS. 20–24.
Figure 23:
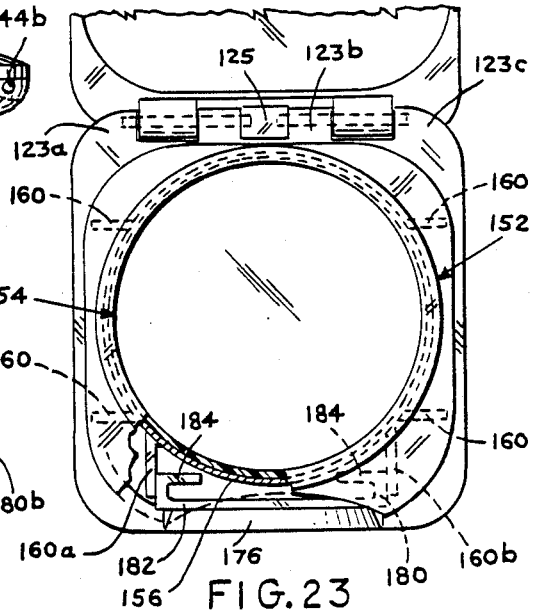
FIG. 23 is a top plan view partially broken away of the compact shown in FIG. 20 in the open position; partially broken away.
Figure 24:
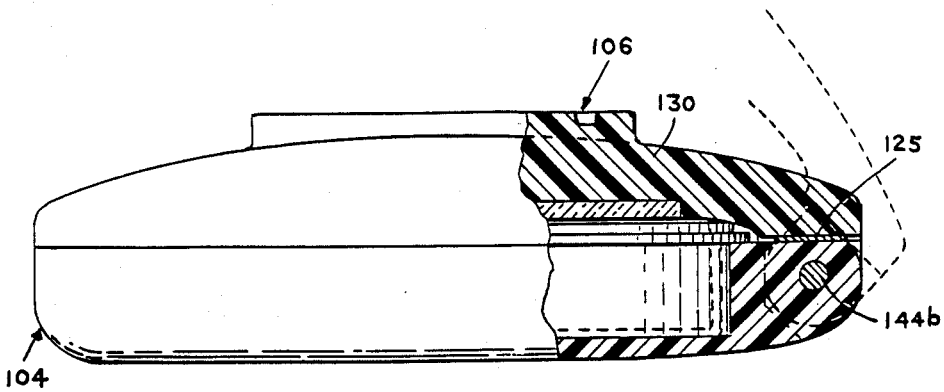
FIG. 24 is a partial cross-sectional view of the compact shown in FIG. 21, taken along line 24—24 thereof.

Further, in accordance with the second embodiment, the resilient or spring means for the front release mechanism 114 is formed of two inwardly extending plastic spring elements 184a and 184b, as shown in FIGS. 23 and 25, which abut against the outer surface of side wall 156 of container 152. The operation of spring elements 184 is substantially identical to that of spring member 84 of the first embodiment of FIGS. 1–19.

OPERATION

This form of the invention differs from the operation of the embodiment of the invention shown in FIGS. 1 to 19, in that when the cover member 106 is biased to the closed position the boss 125 will require the application of additional external force on the cover member to move the cover member 106 into the closed position as is described in the above mentioned U.S. Pat. No. 4,345,607. Thus, as stated above, the boss 125 will act to exert affirmative closing action during use of the compact which will further aid in establishing and maintaining the cover member 106 in the closed position.

Movement to the open position will be accomplished in the same manner as abovedescribed for the form of the invention shown in FIGS. 1 to 19 of the drawings, except that after the latch assembly is released the cover member 106 is then moved over the boss 125 by exerting additional external force on the cover member 106 to move the cover to the full 180° open position.

Movement of the cover member 106 to closed and/or open position will be accompanied by an audible clicking sound which will serve as a signal to the user particularly for compacts of the air tight closure type.

It will be appreciated by those skilled in the art that various modifications can be made to the present invention. For example, while the present invention has been illustrated as being applied to compacts for powder, rouge or other cosmetics, it is equally applicable to any type of container in which an air tight seal is provided within the container and coacts with a front latch assembly and front release mechanism. Further, while the compact has been illustrated as square in plan view, it will be understood by those skilled in the art that the shape and size of the particular container which utilizes the improved front latching assembly and front release mechanism in accordance with the present invention may be of any desired shape, such as round, octagonal, or the like, in accordance with commercial requirements for devices of this type.

Having described specific preferred embodiments of the invention with reference to the accompanying drawings, it is to be understood that the present invention is not limited to those precise embodiments, and that various changes and modifications may be effected therein by one of ordinary skill in the art without departing from the spirit and scope of the present invention as defined by the appended claims.

What is claimed is:

1. A container for holding a material, comprising:

a. a base member having a bottom wall and a first peripheral wall connected thereto to define a receptacle in the base member;

b. a cover member having an inner surface and a second peripheral wall connected thereto;

c. hinge means for hingedly connecting the cover member to the base member for pivotal movement between an open position and a closed position;

d. said first peripheral wall on the base member having a cut-out section at a position remote from the hinge means;

e. a latch member extending from the second peripheral wall on the cover member;

f. an insert assembly disposed in the receptacle defined in said member and secured to said base member thereat, said insert assembly including i. first and second guides positioned interiorly of said cut-out section and on opposite sides thereof;

ii. catch means formed on said insert assembly for engaging said latch member on the cover member in said closed position;

iii. a compartment section for holding said material; and iv. sealing means disposed to extend into sealing contact with the inner surface of said cover member when the cover is pivoted to the closed position; and g. front release means positioned in said cut-out section and reciprocal by slidable movement between said first and second guides for biasing said latch member out of engagement with said catch means upon inward movement of the front release means, to permit the cover member to move from said closed to said open position.

2. A container for holding a material, comprising:

a. base member having a bottom wall and a first peripheral wall connected thereto to define a receptacle in the base member;

b. a cover member having a top wall and a second peripheral wall connected thereto;

c. hinge means for hingedly connecting the cover member to the base member for pivotal movement between an open position and a closed position;

d. said first peripheral wall on the base member having a cut-out section at a position remote from the hinge means;

e. a latch member extending from the second peripheral wall on the cover member;

f. an insert assembly disposed in the receptacle defined in said base member and secured to said base member thereat, said insert assembly including i. first and second guides positioned interiorly of said cut-out section and on opposite sides thereof;

ii. catch means formed on said insert assembly for engaging said latch member on said cover member in said closed position and iii. a compartment section for holding said material, g. front release means positioned in said cut-out section and reciprocal by slidable movement between said first and second guides for biasing said latch member out of engagement with said catch means upon inward movement of said front release means to permit the cover member to move from the closed to the open position, and

3. A container according to claim 1, wherein said compartment section includes a. at least one side wall defining a recess, with said guides secured to said side wall, b. a flange extending from said at least one side wall, with said catch means formed on said flange, and c. a compartment positioned in said recess for holding said material, said compartment including a lip on said sealing means, said lip positioned above said flange into sealing contact with the inner surface of said cover member when the cover is pivoted to the closed position.

* * * * *

UNITED STATES PATENT AND TRADEMARK OFFICE

CERTIFICATE OF CORRECTION

PATENT NO. : 4,917,131

DATED : April 17, 1990

INVENTOR(S) : Joseph P. Contreras, Sr.

It is certified that error appears in the above-identified patent and that said Letters Patent is hereby corrected as shown below:

Column 1, line 41, "cove" should read --cover--.
Column 3, line 60, "s" should read --is--.
Column 10, line 55, after "and" insert
--h. boss means on said base member at a position opposite said cut-out section for biasing said cover member to the closed position when said cover member is pivoted to an intermediate position between the open and closed position.--

Signed and Sealed this

Twenty-seventh Day of August, 1991

*Attest:*

HARRY F. MANBECK, JR.

*Attesting Officer*

*Commissioner of Patents and Trademarks*